US009644631B2

(12) United States Patent
Eguchi et al.

(10) Patent No.: US 9,644,631 B2
(45) Date of Patent: May 9, 2017

(54) MULTI-BLADE CENTRIFUGAL FAN AND AIR CONDITIONER EMPLOYING THE SAME

(71) Applicant: MITSUBISHI HEAVY INDUSTRIES, LTD., Tokyo (JP)

(72) Inventors: Tsuyoshi Eguchi, Tokyo (JP); Atsushi Suzuki, Tokyo (JP); Seiji Sato, Tokyo (JP); Masahiko Takahashi, Aichi (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 78 days.

(21) Appl. No.: 14/660,456

(22) Filed: Mar. 17, 2015

(65) Prior Publication Data

US 2015/0192135 A1 Jul. 9, 2015

Related U.S. Application Data

(62) Division of application No. 13/318,957, filed as application No. PCT/JP2010/065977 on Sep. 15, 2010, now Pat. No. 9,011,092.

(30) Foreign Application Priority Data

Nov. 9, 2009 (JP) ..... 2009-256075

(51) Int. Cl.
*F04D 29/42* (2006.01)
*F04D 17/16* (2006.01)
(Continued)

(52) U.S. Cl.
CPC ..... *F04D 17/16* (2013.01); *F04D 29/281* (2013.01); *F04D 29/4226* (2013.01); *F04D 29/441* (2013.01); *F04D 29/681* (2013.01)

(58) Field of Classification Search
CPC .. F04D 29/441; F04D 29/4206; F04D 29/422; F04D 29/4226; F04D 29/281;
(Continued)

(56) References Cited

U.S. PATENT DOCUMENTS 3,113,593 A * 12/1963 Vicard ..... F15D 1/04 138/39
3,684,396 A * 8/1972 Ball ..... F04D 29/422 415/144
(Continued)

FOREIGN PATENT DOCUMENTS

DE 1070337 B 12/1959
JP 50-084803 U 7/1975
(Continued)

OTHER PUBLICATIONS

International Search Report of PCT/JP2010/065977, mailing date Dec. 21, 2010.
(Continued)

*Primary Examiner* — Igor Kershteyn
*Assistant Examiner* — Justin Seabe
(74) *Attorney, Agent, or Firm* — Westerman, Hattori, Daniels & Adrian, LLP

(57) ABSTRACT

In a multi-blade centrifugal fan in which an impeller is provided in a scroll casing in a freely rotatable manner, the scroll casing is provided with an axially expanded portion that forms an air channel at a bottom surface thereof which is expanded in a rotation-axis direction at a radially outer side of an annular flange portion which supports the impeller; and is provided, in a region of an outlet between a tongue portion and a spiral-end portion of the scroll casing in the axially expanded portion, with a protrusion that protrudes
(Continued)

radially outward from a radially inner side surface by a predetermined amount so as to directly face an airflow in a circumferential direction.

6 Claims, 8 Drawing Sheets

(51) Int. Cl.
*F04D 29/44* (2006.01)
*F04D 29/68* (2006.01)
*F04D 29/28* (2006.01)

(58) Field of Classification Search
CPC ..... F04D 29/66; F04D 29/661; F04D 29/663; F04D 29/667
See application file for complete search history.

(56) References Cited

U.S. PATENT DOCUMENTS

| | | | | |
|---|---|---|---|---|
| 5,399,068 | A | 3/1995 | Park | |
| 5,536,140 | A * | 7/1996 | Wagner | F04D 29/663 415/119 |
| 5,775,123 | A * | 7/1998 | Wakayama | F24F 1/027 454/190 |
| 5,839,879 | A | 11/1998 | Kameoka et al. | |
| 5,997,246 | A | 12/1999 | Humbad | |
| 8,313,284 | B2 * | 11/2012 | Hirata | F04D 29/4226 415/119 |
| 2003/0012649 | A1 | 1/2003 | Sakai et al. | |
| 2008/0279681 | A1 | 11/2008 | Eguchi et al. | |
| 2010/0071875 | A1 * | 3/2010 | Hwang | F04D 29/422 165/80.3 |

FOREIGN PATENT DOCUMENTS

| | | | |
|---|---|---|---|
| JP | 62-070242 | U | 5/1987 |
| JP | 63-069800 | U | 5/1988 |
| JP | 11-91334 | A | 4/1999 |
| JP | 3476085 | B2 | 12/2003 |
| JP | 3622300 | B2 | 2/2005 |
| JP | 3785758 | B2 | 6/2006 |
| JP | 2006-275024 | A | 10/2006 |
| JP | 2006-307830 | A | 11/2006 |
| JP | 2007-205641 | A | 8/2007 |
| JP | 2007-205642 | A | 8/2007 |
| JP | 2008-107036 | A | 5/2008 |
| JP | 2008-261274 | A | 10/2008 |

OTHER PUBLICATIONS

Notification of Reasons for Refusal issued on Nov. 5, 2013, issued in corresponding Japanese Application No. 2009-256075, w/ English translation (6 pages).

Decision of Patent Grant dated May 20, 2014, issued in corresponding Japanese Patent Application No. 2009-256075, with English Translation (6 pages).

* cited by examiner

MULTI-BLADE CENTRIFUGAL FAN AND AIR CONDITIONER EMPLOYING THE SAME

CROSS-REFERENCE TO RELATED APPLICATIONS

This is a divisional application of U.S. patent application Ser. No. 13/318,957, filed on Jan. 10, 2012, which is a 371 of International Application No. PCT/JP2010/065977, filed on Sep. 15, 2010, which claims the benefit of priority from the prior Japanese Patent Application No. 2009-256075, filed on Nov. 9, 2009, the entire contents of which are incorporated herein by references.

TECHNICAL FIELD

The present invention relates to a multi-blade centrifugal fan widely applied to air conditioners for vehicle air conditioning devices, etc., and to an air conditioner employing the same.

BACKGROUND ART

A multi-blade centrifugal fan in which an impeller having a plurality of blades is installed in a scroll casing that has its starting point at a tongue portion is widely applied to blower fans of refrigerating devices, air conditioning devices, or ventilation devices, etc. (hereinafter, simply referred to as air conditioners). In such a multi-blade centrifugal fan, air taken in, in an axial direction, from an inlet provided in a top surface of the scroll casing with the rotation of the impeller passes through between the plurality of blades of the impeller, is forcedly supplied from an inner circumferential side to an outer circumferential side, thereby changing its direction to a centrifugal direction (radial direction), is made to flow out to an air channel in the scroll casing from the impeller, and is subsequently sent in a circumferential direction along an inner circumferential surface thereof to be blown out to the exterior via an outlet.

With such a multi-blade centrifugal fan, it is known that flow reversal toward the impeller occurs near the tongue portion of the scroll casing and that an abnormal noise (irritating noise) is generated by interference between the impeller and the flow in the reverse flow region, vibrations due to turbulence in the flow and vortices in the reverse flow region, as well as interference between the scroll casing and turbulence in the main flow or the vortices, and so on. As a measure against this, Patent Literature 1 proposes a scroll casing whose air-channel bottom surface is inclined downward radially outward from a position at a lower portion of an outer circumferential end of the impeller, thus suppressing the occurrence of vortices.

In addition, in the disclosure in Patent Literature 2, a twisted surface where the angle of an inclined surface thereof increases from a spiral-end portion of the scroll casing toward an outlet region is formed, and a secondary flow flows along the twisted surface so as to be expanded radially inward, thereby preventing interference with the main flow. Furthermore, in the disclosures in Patent Literatures 3, 4, etc., a rib or a secondary-flow suppression vane is provided along the airflow direction at a bottom surface in a region closer to an exit of an air channel of the scroll casing, and a secondary flow toward the impeller is suppressed thereby to reduce noise.

CITATION LIST

Patent Literature

{PTL 1} Publication of Japanese Patent No. 3476085 (see FIGS. 4 to 5).
{PTL 2} Publication of Japanese Patent No. 3622300 (see FIGS. 1 to 3).
{PTL 3} Publication of Japanese Patent No. 3785758 (see FIGS. 1 to 4).
{PTL 4} Japanese Unexamined Patent Application, Publication No. 2006-307830 (see FIGS. 2 to 3 and FIG. 5).

SUMMARY OF INVENTION

Technical Problem

As described above, with a multi-blade centrifugal fan, although the airflow direction is changed in an impeller from an axial flow to a centrifugal flow, most of the flow fails to turn completely due to an inertial force, and the flow in the impeller deviates toward the bottom surface (motor) of the scroll casing. This deviation flow flows out to a channel on the bottom of the scroll casing and forms a complex flow with a main flow along an inner circumferential surface of the scroll casing and a secondary flow in a direction perpendicular thereto. Furthermore, because there is interference with a tongue portion in the vicinity of the tongue portion and because of the influence of speed reduction at a diffuser portion (an abruptly expanded portion of the channel) in the outlet portion of the scroll casing, the flow tends to be unstable over an area from before and after the tongue portion to the diffuser portion, and abnormal noise (low-frequency noise) is sometimes generated depending on the operating conditions.

In particular, in relation to the recent size reduction of air conditioners, the aspect ratio (the ratio of a blade axial-direction length B on an outlet side of an impeller to an outer diameter D of the impeller, B/D) tends to be increased so that sufficient volume flow can be ensured while reducing the outer diameter of a multi-blade centrifugal fan. Because of this, the deviation in the flow in the impeller becomes prominent, and, at a motor side, where the volume flow increases, the flow-out direction of air that flows out from the impeller becomes relatively outward in a radial direction as compared with an impeller having a small aspect ratio. As a result, the flow at the tongue portion tends to be separated therefrom, and flow reversal toward the impeller and vortices due to the flow separation simultaneously occur near the tongue portion, sometimes causing a phenomenon in which vortices swirl up from bottom to top, which makes the above-described conventional countermeasures inadequate to control the turbulence in the flow over the area from before and after the tongue portion to the diffuser portion in the outlet region.

The present invention has been conceived in light of the above-described circumstances, and an object thereof is to provide a multi-blade centrifugal fan that is capable of reducing low-frequency noise generated due to destabilization, turbulence, and deviation in a flow over an area from before and after a tongue portion to a diffuser portion in an outlet region and to provide an air conditioner employing the same.

Solution to Problem

To solve the above-described problems, the multi-blade centrifugal fan of the present invention, as well as the air conditioner employing the same, provide the following solutions.

Specifically, a multi-blade centrifugal fan according to a first aspect of the present invention is a multi-blade centrifugal fan including an impeller having numerous blades and provided in a freely rotatable manner in a scroll casing formed in a spiral shape with a tongue portion serving as its starting point, wherein the scroll casing is provided with an axially expanded portion that forms an air channel that is expanded in a rotation axis direction at a radially outer side of an annular flange portion that supports the impeller at the bottom surface of the scroll casing; and, in a region of an outlet between the tongue portion and a spiral-end portion of the scroll casing in the axially expanded portion, a protrusion that protrudes radially outward from a radially inner side surface by a predetermined amount so as to directly face an airflow in a circumferential direction is provided.

With the multi-blade centrifugal fan according to the first aspect of the present invention, because the protrusion that protrudes radially outward from the radially inner side surface by the predetermined amount so as to directly face the airflow in the circumferential direction is provided in the outlet region at the intermediate location between the tongue portion and the spiral-end portion of the axially expanded portion that forms the air channel expanded in the rotation-axis direction at the bottom surface of the scroll casing, the flow can be locally separated by the protrusion provided at the intermediate location between the tongue portion and the spiral-end portion of the scroll casing, and the flow can be stabilized with this localized flow separation, thereby making it possible to stabilize fluctuations in turbulence in a main flow and vortices occurring near the tongue portion. As a result, an airflow in a region downstream of the tongue portion can be stabilized, and thus, low-frequency noise (abnormal noise) having frequency components near 500 Hz generated when turbulence in a flow near the tongue portion reaches the diffuser portion (an abruptly expanded portion of the channel) can be reduced In the multi-blade centrifugal fan according to the first aspect of the present invention, it is preferable that the height of the protrusion in the rotation axis direction be substantially the same as the height of the annular flange portion.

With this configuration, because the height of the protrusion in the rotation-axis direction is set to be substantially the same height as that of the annular flange portion, the protrusion can be made to directly face only a main flow that flows in the air channel in the axially expanded portion without interrupting an airflow that flows out into the air channel from the impeller and can locally cause appropriate separation of the flow. Accordingly, the airflow over an area from the vicinity of the tongue portion to the exit of the diffuser portion in the outlet region can be stabilized, and the occurrence of low-frequency noise can be suppressed.

In addition, in the multi-blade centrifugal fan according to the first aspect of the present invention, it is preferable that the protrusion be integrally molded with a lower casing of the scroll casing by making a portion of an inner circumferential wall of an air channel inside the axially expanded portion, which is expanded in the rotation axis direction of the scroll casing, protrude inward in the air channel.

With this configuration, because the protrusion is integrally molded with the lower casing of the scroll casing by making a portion of the inner circumferential wall of the air channel in the axially expanded portion, which is expanded in the rotation-axis direction of the scroll casing, protrude inward, when providing the protrusion in the air channel in the axially expanded portion, it suffices to integrally mold it with the lower casing by making a portion of the inner circumferential wall protrude inward in the air channel; therefore, it is possible to reduce an increase in the number of processing steps and an increase in cost caused by providing the protrusion.

Furthermore, in the multi-blade centrifugal fan according to the first aspect of the present invention, it is preferable that, over an area from the vicinity of the tongue portion in the region of the outlet to an exit of a diffuser portion, the scroll casing be provided with multiple rows of rib-like protrusions so as to protrude along an airflow direction on a wall surface of the diffuser portion.

With this configuration, because the multiple rows of rib-like protrusions are provided so as to protrude along the airflow direction on the wall surface of the diffuser portion over the area from the vicinity of the tongue portion in the outlet region of the scroll casing to the exit of the diffuser portion (an abruptly expanded portion of the channel), instability of a secondary flow that flows in a direction perpendicular to the circumferential-direction main flow that flows in the axially expanded portion of the scroll casing can be suppressed with the rib-like protrusions provided so as to protrude along the airflow direction. Therefore, the secondary flow over the area from the vicinity of the tongue portion in the outlet region to the exit of the diffuser portion can be stabilized without interrupting the flow of the main flow, and the occurrence of low-frequency noise (abnormal noise) near 250 Hz and near 500 Hz can be reduced.

In the above-described multi-blade centrifugal fan, it is preferable that the rib-like protrusions be integrally molded with the wall surface of the diffuser portion of the scroll casing.

With this configuration, because the rib-like protrusions are integrally molded with the wall surface of the diffuser portion of the scroll casing, when providing the rib-like protrusions on the wall surface of the diffuser portion, it suffices to integrally mold them with the wall surface by making portions thereof protrude toward the inner surface; therefore, it is possible to reduce an increase in the number of processing steps and an increase in cost caused by providing the rib-like protrusions.

A multi-blade centrifugal fan according to a second aspect of the present invention is a multi-blade centrifugal fan including an impeller having numerous blades and provided in a freely rotatable manner in a scroll casing formed in a spiral shape with a tongue portion serving as its starting point, wherein the scroll casing is provided with an axially expanded portion that forms an air channel that is expanded in a rotation axis direction at a radially outer side of an annular flange portion that supports the impeller at the bottom surface of the scroll casing; and a sub-blade that simultaneously controls a secondary flow and the occurrence of turbulence in an airflow and vortices is provided along an airflow direction at a position closer to an inner circumferential side than a center portion of a wall surface of a diffuser portion in a region of an outlet in the axially expanded portion downstream of a spiral-end portion of the scroll casing.

With the multi-blade centrifugal fan according to the second aspect of the present invention, because the sub-blade that simultaneously controls a secondary flow and the occurrence of turbulence in a main flow and vortices is provided at a position closer to the inner circumference side than the center portion of the wall surface of the diffuser portion in the outlet region downstream of the spiral-end portion of the axially expanded portion that forms the air channel expanded in the rotation-axis direction at the bottom surface of the scroll casing, an airflow in the outlet region downstream of the spiral-end portion of the scroll casing can be rectified with the sub-blade, the occurrence of flow reversal and turbulence in the main flow and vortices before and after the tongue portion can be suppressed, and instability of the secondary flow in the direction perpendicular to the main flow can also be suppressed. Therefore, low-frequency noise (abnormal noise) having frequency components near 250 Hz and near 500 Hz generated when turbulence in the flow before and after the tongue portion reaches the diffuser portion (an abruptly expanded portion of the channel) can be reduced.

In the multi-blade centrifugal fan according to the second aspect of the present invention, it is preferable that a top end of the sub-blade be substantially the same height as the annular flange portion of the scroll casing, and an area from an upstream end to a downstream end is kept at substantially the same height.

With this configuration, because the height of the top end of the sub-blade is set to be substantially the same height as that of the annular flange portion of the scroll casing, and the height thereof from the upstream side to the downstream side is kept substantially the same, the sub-blade does not interrupt an airflow that flows out from the impeller, can rectify the main flow of the airflow that flows in the axially expanded portion, and can suppress the occurrence of turbulence and vortices and instability of the secondary flow. Therefore, the airflow over an area from before and after the tongue portion to the exit of the diffuser portion in the outlet region can be stabilized, and the occurrence of low-frequency noise near 250 Hz and near 500 Hz can be suppressed.

In addition, in the multi-blade centrifugal fan according to the second aspect of the present invention, it is preferable that the sub-blade be integrally molded with a wall surface of the diffuser portion in the region of the outlet downstream of the spiral-end portion of the scroll casing.

With this configuration, because the sub-blade is integrally molded with the wall surface of the diffuser portion in the outlet region downstream of the spiral-end portion of the scroll casing, when providing the sub-blade on the wall surface of the diffuser portion, it suffices to integrally mold it on the wall surface by making a portion thereof protrude into the air channel in the outlet region; therefore, it is possible to reduce an increase in the number of processing steps and an increase in cost caused by providing the sub-blade.

A multiple-blade centrifugal fan according to a third aspect of the present invention is a multi-blade centrifugal fan including an impeller having numerous blades and provided in a freely rotatable manner in a scroll casing formed in a spiral shape with a tongue portion serving as its starting point, wherein the scroll casing is provided with an axially expanded portion that forms an air channel that is expanded in a rotation axis direction at a radially outer side of an annular flange portion that supports the impeller at the bottom surface of the scroll casing; and a vortex control plate whose height in a rotation-axis direction is gradually increased over an area from upstream of the tongue portion to an inner circumferential side surface in a region of an outlet is provided near the tongue portion in the region of the outlet in the axially expanded portion downstream of a spiral-end portion of the scroll casing.

With the multi-blade centrifugal fan according to the third aspect of the present invention, a vortex control plate whose height in the rotation-axis direction is gradually increased over an area from upstream of the tongue portion to the inner circumferential surface of the outlet region is provided near the tongue portion in the outlet region downstream of the spiral-end portion of the axially expanded portion that forms the air channel expanded in the rotation-axis direction of the scroll casing; therefore, it is possible to suppress unstable fluctuations of vortices, in which flow reversal of a flow and vortices due to flow separation simultaneously occur near the tongue portion and the vortices swirl up from a lower portion of the axially expanded portion toward an upper portion thereof. Therefore, low-frequency noise (abnormal noise) having frequency components near 500 Hz generated when turbulence in the flow before and after the tongue portion reaches the diffuser portion (an abruptly expanded portion of the channel) can be reduced.

In the multi-blade centrifugal fan according to the third aspect of the present invention, it is preferable that the vortex control plate be extended to a portion above the annular flange portion at the bottom surface of the scroll casing.

With this configuration, because the vortex control plate extends to the portion above the annular flange portion at the bottom surface of the scroll casing, the unstable fluctuations of vortices, where the vortices swirl up from the lower portion of the axially expanded portion near the tongue portion toward the upper portion of the annular flange portion, can be suppressed with the vortex control plate which is extended to the portion above the annular flange portion. Therefore, low-frequency noise generated when turbulence in the flow before and after the tongue portion reaches the diffuser portion (an abruptly expanded portion of the channel) can be reduced.

In addition, in the multi-blade centrifugal fan according to the third aspect of the present invention, it is preferable that a secondary-flow control plate that controls a secondary-flow at the diffuser portion be provided at an outer circumferential side surface which faces an inner circumferential side surface, that is, the side on which the vortex control plate is provided, in the region of the outlet over an area from the vicinity of the tongue portion to the exit of the diffuser portion.

With this configuration, because the secondary-flow control plate that controls a secondary-flow at the diffuser portion is provided on the outer circumferential side surface which faces the inner circumferential side surface of the outlet region, that is, the side on which the vortex control plate is provided, over the area from the vicinity of the tongue portion to the exit of the diffuser portion, instability of a secondary flow that flows in the direction perpendicular to the circumferential airflow which flows in the axially expanded portion of the scroll casing can be reduced with the secondary-flow control plate provided on the outer circumferential side surface of the outlet region. Therefore, the secondary flow over an area from the vicinity of the tongue portion to the exit of the diffuser portion can be stabilized, and the occurrence of low-frequency noise (abnormal noise) near 250 Hz and near 500 Hz can be reduced.

Furthermore, in the multi-blade centrifugal fan according to the third aspect of the present invention, it is preferable that the height of a top end of the secondary-flow control plate be substantially the same height in an area from an upstream end to a downstream end thereof.

With this configuration, because the height of the top end of the secondary-flow control plate is set to be substantially the same height from the upstream side to the downstream side, instability of the secondary flow over the area from the vicinity of the tongue portion to the exit of the diffuser portion can be reduced reliably and stabilized. As a result, turbulence in the airflow over the area from the vicinity of the tongue portion to the exit of the diffuser portion can be stabilized, and the occurrence of low-frequency noise can be suppressed.

Additionally, in the multi-blade centrifugal fan according to the third aspect of the present invention, it is preferable that the vortex control plate and the secondary-flow control plate be integrally molded with a lower casing of the scroll casing.

With this configuration, because the vortex control plate and the secondary-flow control plate are integrally molded with the lower casing of the scroll casing, when providing the vortex control plate and the secondary-flow control plate at the inner circumferential side surface near the tongue portion and the outer circumferential side surface over the area from the vicinity of the tongue portion to the exit of the diffuser portion, respectively, it suffices to integrally mold them with the wall surfaces of the lower casing by making portions thereof protrude inward in the air channel; therefore, it is possible to reduce an increase in the number of processing steps and an increase in cost caused by providing the vortex control plate and the secondary-flow control plate.

Furthermore, an air conditioner according to a fourth aspect of the present invention is an air conditioner in which any one of the above-described multi-blade centrifugal fans is installed.

With the air conditioner according to the fourth aspect of the present invention, because any one of the multi-blade centrifugal fans described above is employed as a blower fan to be installed in the air conditioner, a high-performance multi-blade centrifugal fan in which the occurrence of low-frequency noise is reduced can be installed; therefore, it is possible to achieve further noise reduction and performance enhancement in the air conditioner.

Advantageous Effects of Invention

With the multi-blade centrifugal fan of the present invention, flow reversal and flow separation near a tongue portion can prevented and turbulence in a main flow and fluctuations of vortices occurring near the tongue portion can be stabilized; therefore, the airflow in a region downstream of the tongue portion can be stabilized, deviation thereof can be suppressed, and low-frequency noise (abnormal noise), having frequency components near 500 Hz in particular, generated when turbulence in a flow near the tongue portion reaches the diffuser portion (an abruptly expanded portion of the channel) can be reduced.

In addition, with the multi-blade centrifugal fan of the present invention, with a sub-blade, the occurrence of flow reversal and turbulence in a main flow and vortices before and after the tongue portion can be suppressed and instability of a secondary flow in a direction perpendicular to the main flow can also be suppressed; therefore, low-frequency noise (abnormal noise) having frequency components near 250 Hz and near 500 Hz generated when turbulence in the flow before and after the tongue portion reaches the diffuser portion (an abruptly expanded portion of the channel) can be reduced.

Furthermore, with the multi-blade centrifugal fan of the present invention, unstable fluctuations of the vortices, in which flow reversal of a flow and vortices due to flow separation simultaneously occur near the tongue portion and the vortices swirl up from a lower portion of an axially expanded portion toward an upper portion thereof, can be suppressed by the vortex control plate; therefore, low-frequency noise (abnormal noise) having frequency components near 500 Hz generated when turbulence in the flow before and after the tongue portion reaches the diffuser portion (an abruptly expanded portion of the channel) can be reduced.

Additionally, with the air conditioner of the present invention, because a high-performance multi-blade centrifugal fan in which the occurrence of low-frequency noise is reduced can be installed, it is possible to achieve further noise reduction and performance enhancement in the air conditioner.

DESCRIPTION OF EMBODIMENTS

Embodiments of the present invention will be described below with reference to the drawings.

{First Embodiment}

Figure 1:
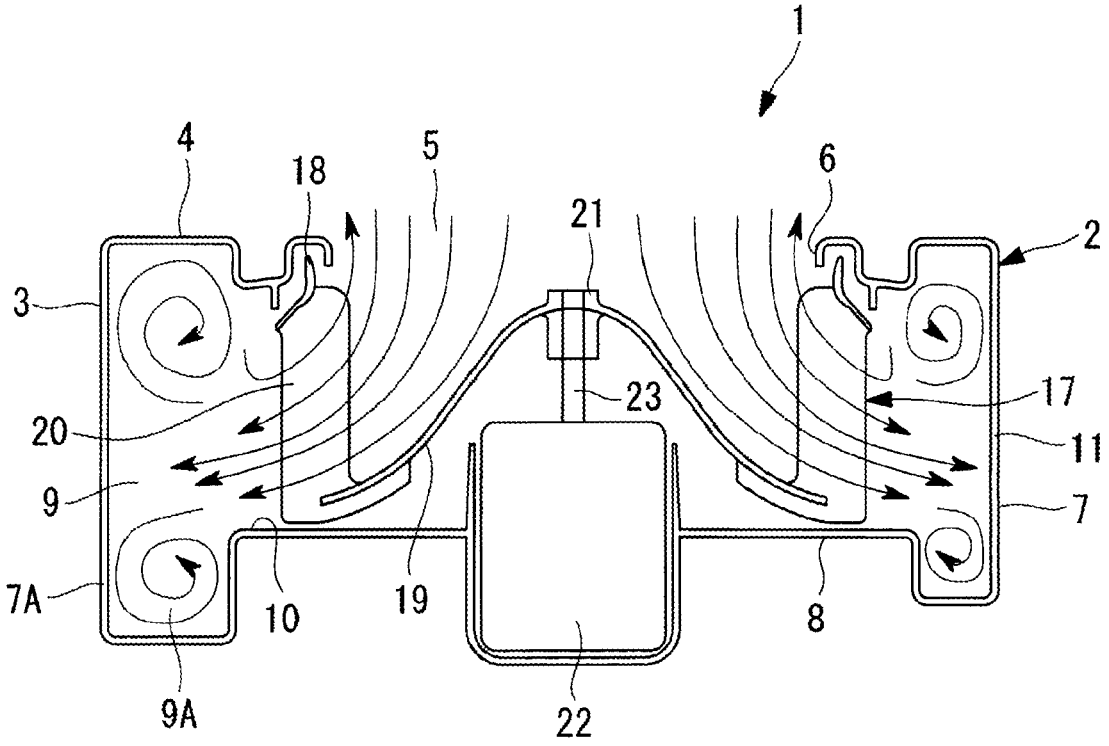
FIG. 1 is a longitudinal sectional view of a multi-blade centrifugal fan according to a first embodiment of the present invention.
Figure 2:
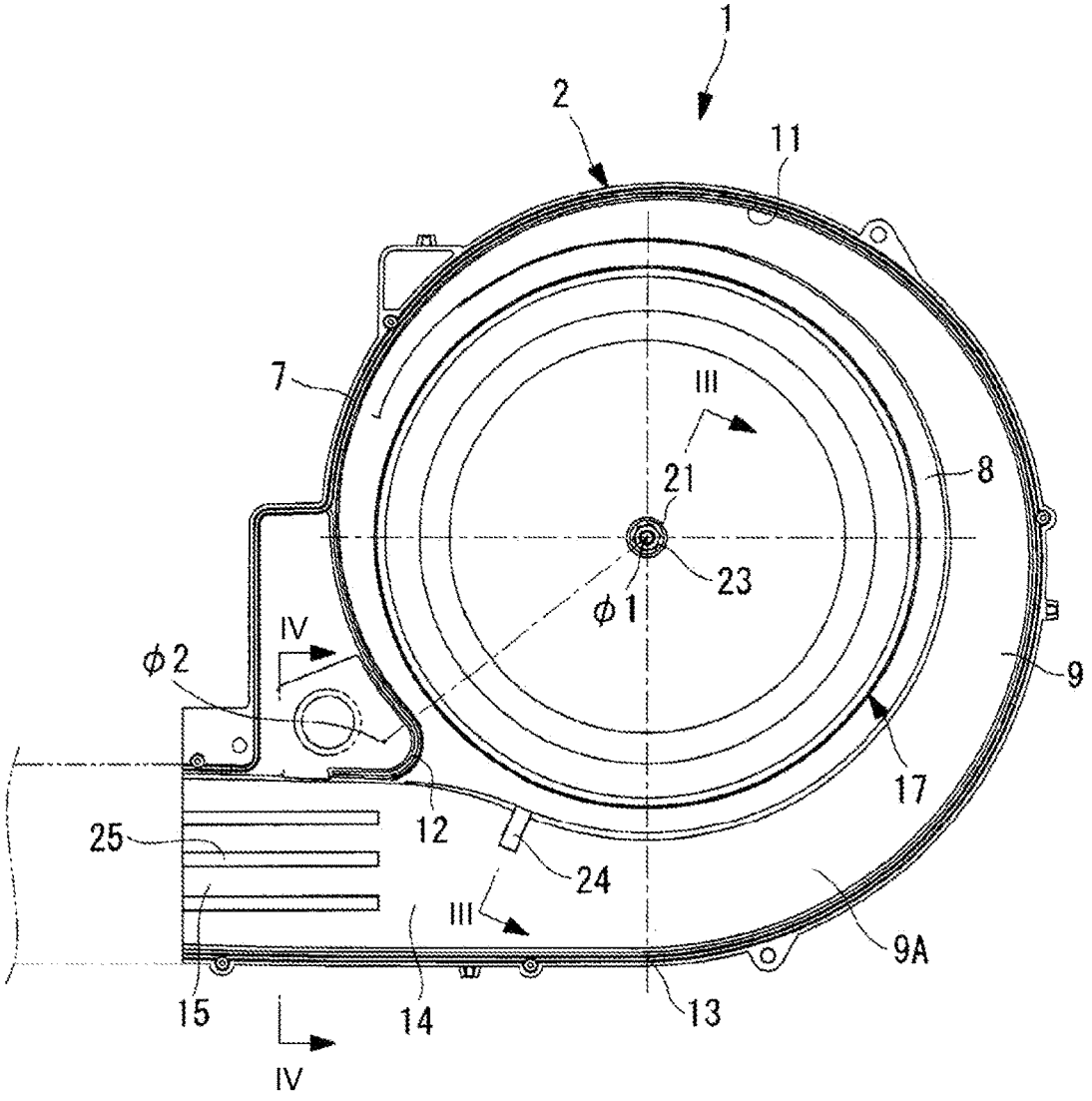
FIG. 2 is a lateral sectional view in which the multi-blade centrifugal fan shown in FIG. 1 is laterally sectioned and viewed from a lower casing side.

A first embodiment of the present invention will be described below by using FIGS. 1 to 4 and FIGS. 9 and 10. FIG. 1 shows a longitudinal sectional view of a multi-blade centrifugal fan according the first embodiment of the present invention, and FIG. 2 shows a lateral sectional view thereof, viewed from a lower-casing side.

A multi-blade centrifugal fan 1 is provided with a scroll casing 2 that is formed in a spiral shape (scroll shape) and is made of a plastic material.

The scroll casing 2 is formed of an upper casing 3 provided with a bell mouth 6, which forms an inlet 5 at a top surface 4, and a lower casing 7 in which an air channel 9 is formed at an outer circumference of an annular flange portion 8 that supports a motor 22 and an impeller 17. The upper casing 3 and the lower casing 7 are divided into two portions at an appropriate position in the vertical direction (rotation-axis direction), each of which is molded from a plastic material, and form the scroll casing 2 by being connected into a single unit. The scroll casing 2 has the top surface 4, a bottom surface (flange surface) 10, and an outer circumferential surface 11 and is formed in a spiral shape with a tongue portion 12 serving as a starting point.

The scroll casing 2 is provided with an outlet 14 that is extended in a tangential direction from a spiral-end portion 13 located upstream of the tongue portion 12 which is a spiral-start portion of the scroll casing 2; a region of the outlet 14 on a downstream side of the tongue portion 12 serves as a diffuser portion (an abruptly expanded portion of a channel) 15 (see FIGS. 6 and 8) where the air channel 9 is abruptly expanded in the top-bottom direction; and the diffuser portion 15 is connected to an air conditioning unit (not shown) on a downstream side thereof.

The impeller 17 formed by providing numerous blades 20 between a shroud 18 and a hub 19 is disposed inside the above-described scroll casing 2. The impeller 17 is supported in a freely rotatable manner via the motor 22 by securing a boss 21 provided at the center of the hub 19 to a rotation shaft 23 of the motor 22 installed at the center of the annular flange portion 8 of the lower casing 7. Note that, in this example, the spiral-end portion 13 of the scroll casing 2 is located at, for example, $\Theta \approx 31°$, when a spiraling angle in the rotation direction of the impeller 17 is defined as $\Theta$, with reference to a line that joins a center $\Phi 1$ of the rotation shaft 23 of the impeller 17 and a center $\Phi 2$ of the tongue portion 12 of the scroll casing 2.

In addition, the cross-sectional area of the air channel 9 formed by the scroll casing 2 on an outflowing-air side of the impeller 17 gradually increases in a spiraling direction over an area from the tongue portion 12 of the scroll casing 2 to the spiral-end portion 13 thereof; however, to expand the cross-sectional area of the air channel 9 also in the rotation-axis direction, an axially expanded portion 7A that forms an air channel 9A, which is expanded in the rotation-axis direction, is integrally molded in the lower casing 7 at the radially outer side of the annular flange portion 8, which supports the impeller 17 and the drive motor 22 on a bottom surface (flange surface) 10 side of the lower casing 7.

In the multi-blade centrifugal fan 1 described above, air taken in, in the axial direction, from the inlet 5 via the impeller 17 is pressurized in the impeller 17 while the direction thereof is changed to the centrifugal direction and is made to flow out in the tangential direction of the impeller 17 from the outer edge of each blade 20 into the air channel 9 in the scroll casing 2, as shown in FIG. 1. This airflow is forcedly supplied toward the outlet 14 while being gradually pressurized while passing along the inner circumferential surface of the scroll casing 2 and is blown into the air conditioning unit downstream thereof via the diffuser portion (the abruptly expanded portion of the channel) 15 located downstream of the outlet 14.

During this process, the airflow changes its direction in the impeller 17 from the axial direction to the centrifugal direction (radial direction); however, most of the flow fails to turn completely due to an inertial force, and the flow inside the impeller becomes a flow deviated toward the bottom surface 10 (motor 22). This deviation tends to be more prominent in the multi-blade centrifugal fan 1 having a larger aspect ratio (the ratio of a blade axial-direction length B on an outlet side of the impeller 17 to an outer diameter D of the impeller 17, B/D). Because of this, a proportion of the airflow quantity on the scroll-casing bottom surface 10 side (motor 22 side) increases; the flow-out direction of the air from the impeller 17 changes from the tangential direction to relatively radially outward; and it becomes easier for flow separation to occur at the tongue portion 12.

Figure 3:
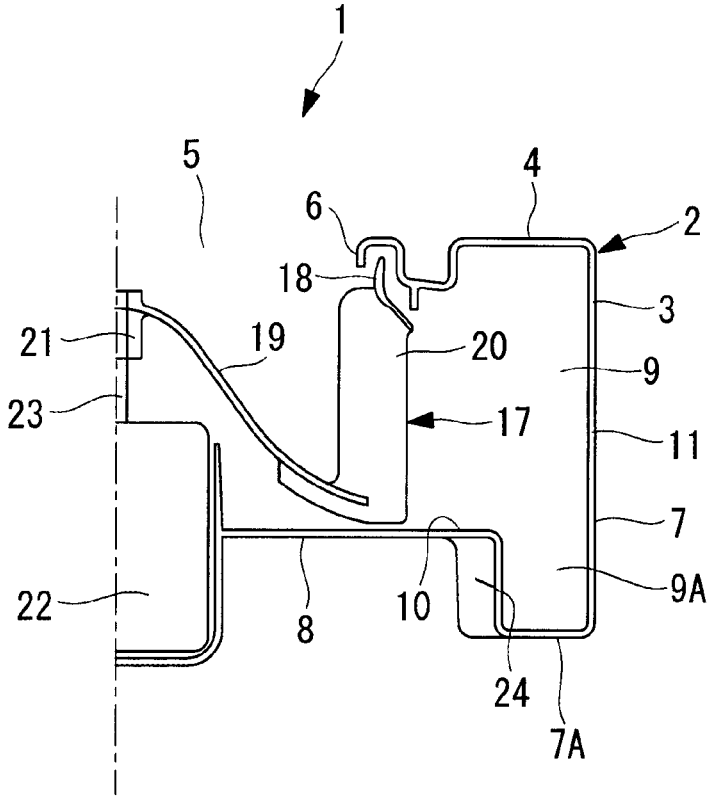
FIG. 3 is a sectional view of the multi-blade centrifugal fan shown in FIG. 2 taken along a-a.

Therefore, to suppress the above-described flow separation near the tongue portion 12 and also to suppress flow reversal of the flow near the tongue portion 12 toward the impeller 17, the configuration of this embodiment is provided with a protrusion 24 that is, as shown in FIG. 3, integrally molded with the lower casing 7 on an inner circumferential wall of the axially expanded portion 7A by making a portion of the wall surface protrude toward an air channel 9A side in the region of the outlet 14 at an intermediate location between the spiral-end portion 13 of the scroll casing 2 and the tongue portion 12 thereof. This protrusion 24 protrudes radially outward from a radially inner side surface by a predetermined amount in the radial direction so as to directly face a circumferential airflow; for example, the widthwise size in the circumferential direction is about 5 mm, the amount of protrusion in the radial direction is about 10 mm, and the height in the rotation-axis direction is substantially the same height as the height of the bottom surface 10 of the annular flange portion 8.

In addition, with respect to the main flow of the circumferential airflow along the inner circumferential surface of the air channel 9 in the scroll casing 2 of the multi-blade centrifugal fan 1, a secondary flow (see FIG. 1) is generated in the air channel 9A in the axially expanded portion 7A in a direction perpendicular to the main flow. Instability of the secondary flow disturbs the flow in the region of the outlet 14, thus causing abnormal noise (low-frequency noise) to be generated at the diffuser portion 15 depending on the operating conditions. Therefore, as shown in FIG. 2, to reduce the instability of the secondary flow, multiple rows of rib-like protrusions 25 are provided on the wall surface of the diffuser portion 15 so as to protrude along the airflow direction over an area from the vicinity of the tongue portion 12 in the region of the outlet 14 to the exit of the diffuser portion 15.

Figure 4A:
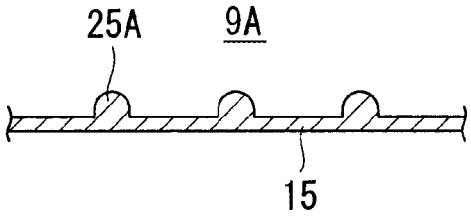
FIG. 4A is a sectional view of the multi-blade centrifugal fan shown in FIG. 2 taken along b-b.
Figure 4B:
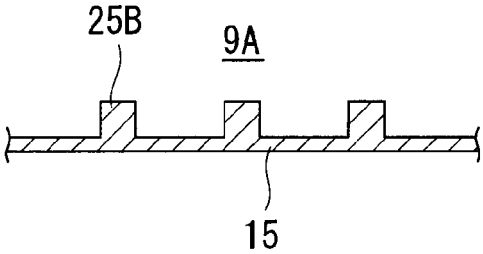
FIG. 4B is a sectional view of the multi-blade centrifugal fan shown in FIG. 2 taken along b-b.

As shown in FIGS. 4A and 4B, with respect to their sectional shapes, these rib-like protrusions 25 are formed as semi-circular rib-like protrusions 25A, rectangular rib-like protrusions 25B, triangular rib-like protrusions, etc. which are integrally molded with the wall surface of the diffuser portion 15 of the scroll casing 2 so as to protrude inward in the channel and are provided so as to be perpendicular to the secondary flow.

With the configuration described above, this embodiment affords the following effects and advantages.

The air taken in, in the axial direction, from the inlet 5 via the bell mouth 6 with the rotation of the impeller 17 passes through between the plurality of blades 20 of the impeller 17, is forcedly supplied from the inner circumferential side to the outer circumferential side by changing the direction in the centrifugal direction, and is made to flow out to the air channel 9. This airflow is forcedly supplied in the circumferential direction along the inner circumferential surface of the air channel 9 in the scroll casing 2 while the static pressure thereof increases, and is blown out to the exterior from the outlet 14 via the diffuser portion 15 where the channel is abruptly expanded in the vertical direction.

This airflow sometimes flows in reverse near the tongue portion 12 of the scroll casing 2 toward the impeller 17, and abnormal noise is generated due to interference, etc. between the impeller 17 and the reverse flow region. In addition, the airflow in the impeller 17 becomes a flow deviated toward the bottom surface 10 side (motor 22 side) of the scroll casing 2; this tendency is stronger (see FIG. 1) in the multi-blade centrifugal fan 1 having a larger aspect ratio (the ratio of the blade axial-direction length B on an outlet side of the impeller 17 to the outer diameter D of the impeller 17, B/D); and the flow-out direction of the air from the impeller 17 tends to be relatively radially outward. Accordingly, a condition is created where the flow near the tongue portion 12 is easily separated therefrom.

Therefore, in this embodiment, the protrusion 24 that protrudes radially outward by the predetermined amount from the radially inner side surface so as to directly face the circumferential airflow is provided in the region of the outlet 14 at the intermediate location between the tongue portion 12 and the spiral-end portion 13 of the axially expanded portion 7A that forms the air channel 9A expanded in the rotation-axis direction at the bottom surface of the scroll casing 2, and the flow is locally separated in the air channel 9A by the protrusion 24. By stabilizing the flow by means of this localized flow separation, the turbulence in the main flow and the fluctuations in vortices occurring near the tongue portion 12 can be stabilized.

Figure 9:
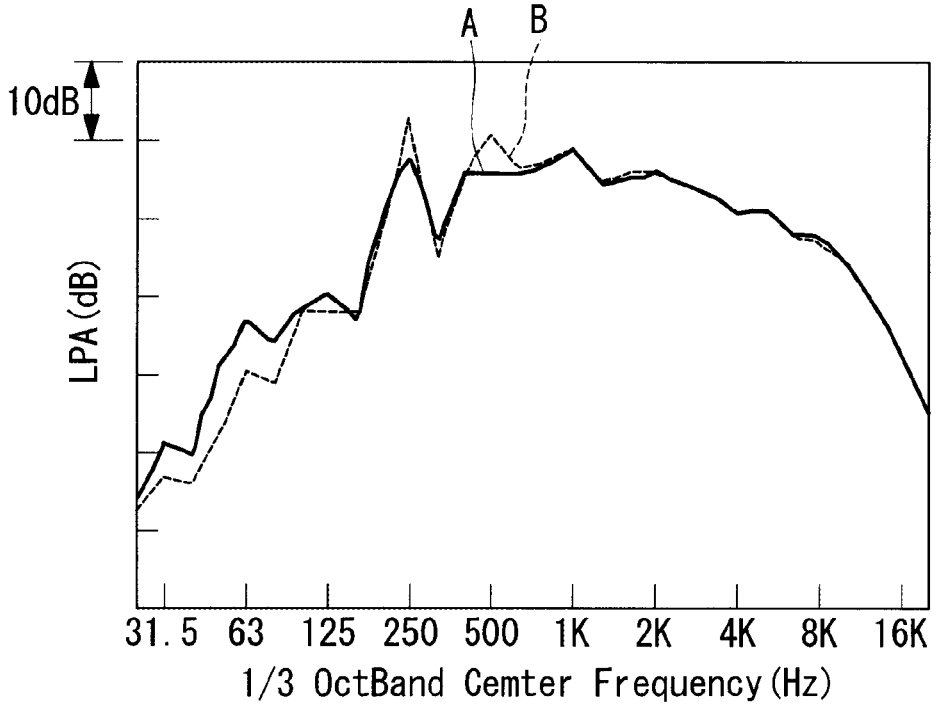
FIG. 9 is a diagram showing the noise reduction effect of the multi-blade centrifugal fan shown in FIG. 2 when only a protrusion is provided.

As a result, the airflow in the region downstream of the tongue portion 12 can be stabilized, and low-frequency noise (abnormal noise), having frequency components near 500 Hz in particular, which is generated when the turbulence of the flow near the tongue portion 12 reaches the diffuser portion 15, can be reduced. FIG. 9 is a diagram showing the noise reduction effect of providing the protrusion 24; it was experimentally confirmed that, as compared with curve B for the case without the protrusion 24, low-frequency noise having the frequency components near 500 Hz was reduced in curve A for the case with the protrusion 24 and that an overall noise reduction of about 1.4 dBA was obtained. Note that, although low-frequency noise having frequency components of 125 Hz or below was slightly increased, the low-frequency noise of 125 Hz or below is outside of the audible range, and it does not present a problem because it cannot be heard.

In addition, because the height of the protrusion 24 in the rotation-axis direction is substantially the same height as the height of the bottom surface 10 of the annular flange portion 8, the protrusion 24 can be made to directly face only the main flow that flows in the air channel 9A of the axial-direction expanded portion 7A without interrupting the airflow that flows out to the air channel 9 from the impeller 17, and can cause appropriate localized separation in the flow thereof. Therefore, the airflow over the area from the vicinity of the tongue portion 12 to the exit of the diffuser portion 15 in the region of the outlet 14 can be stabilized, and the occurrence of low-frequency noise can be suppressed.

In addition, the above-described protrusion 24 is integrally molded with the lower casing 7 of the scroll casing 2 by making a portion of the inner circumferential wall of the air channel 9A in the axially expanded portion 7A, which is expanded in the rotation-axis direction of the scroll casing 2, protrude inward. Accordingly, when providing the protrusion 24 in the axially expanded portion 7A, it suffices to integrally mold it in the lower casing 7 by making a portion of the inner circumferential wall protrude inward in the air channel 9A; therefore, it is possible to suppress an increase in the number of processing steps and an increase in cost caused by providing the protrusion 24.

Furthermore, in addition to the protrusion 24, the configuration of this embodiment is provided with the rib-like protrusions 25 (semicircular rib-like protrusions 25A, rectangular rib-like protrusions 25B, etc.) in multiple rows on the wall surface of the diffuser portion 15 so as to protrude along the airflow direction over the area from the vicinity of the tongue portion 12 in the region of the outlet 14 of the scroll casing 2 to the exit of the diffuser portion 15. Accordingly, the instability of the secondary flow (see FIG. 1) that flows in the direction perpendicular to the circumferential-direction main flow that flows in the air channel 9A of the axially expanded portion 7A can be stabilized with the rib-like protrusions 25 provided so as to protrude along the airflow direction. Therefore, the secondary flow over the area from the vicinity of the tongue portion 12 in the region of the outlet 14 to the exit of the diffuser portion 15 can be stabilized, and the occurrence of low-frequency noise (abnormal noise) near 250 Hz and near 500 Hz can both be reduced.

Figure 10:
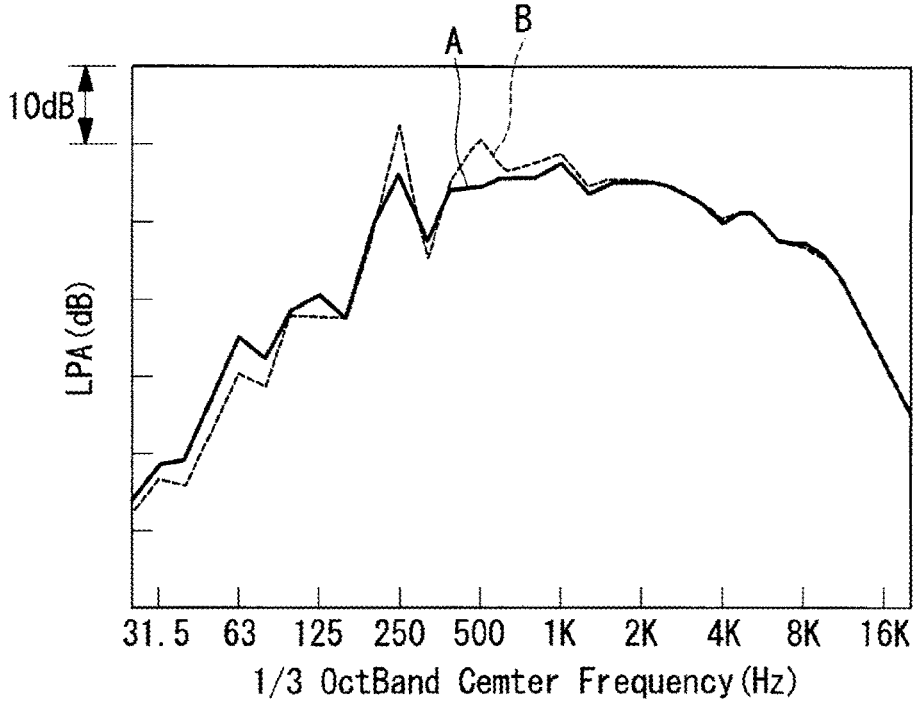
FIG. 10 is a diagram showing the noise reduction effect of the multi-blade centrifugal fan shown in FIG. 2 when a protrusion and a columnar protrusion are provided.

FIG. 10 is a diagram showing the noise reduction effect when the protrusion 24 and the rib-like protrusions 25 are provided; it was experimentally confirmed that, as compared with curve B for the case without the protrusion 24 or the rib-like protrusions 25, curve A for the case with the protrusion 24 and the rib-like protrusions 25 shows that low-frequency noise having frequency components near 250 Hz and near 500 Hz were both reduced and that an overall noise reduction effect of about 2 dBA was obtained.

In addition, the above-described rib-like protrusions 25 are integrally molded on the wall surface of the diffuser portion 15 of the scroll casing 2. Accordingly, when providing the rib-like protrusions 25 on the wall surface of the diffuser portion 15, it suffices to integrally mold them by making portions of the wall surface protrude inward; therefore, it is possible to suppress an increase in the number of processing steps and an increase in cost caused by providing the rib-like protrusions 25.

{Second Embodiment}

Figure 11:
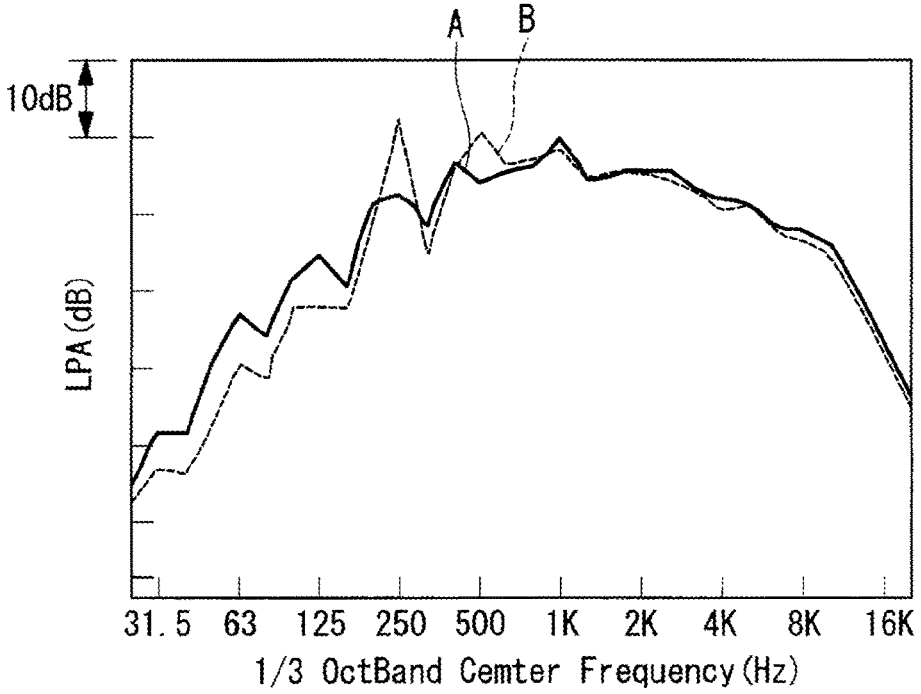
FIG. 11 is a diagram showing the noise reduction effect of the multi-blade centrifugal fan shown in FIG. 5.

Next, a second embodiment of the present invention will be described by using FIGS. 5, 6, and 11.

The configuration of this embodiment differs from the above-described first embodiment in that a sub-blade 26 is provided instead of the protrusion 24 and the rib-like protrusions 25. Because other points are the same as those of the first embodiment, descriptions thereof will be omitted.

Figure 5:
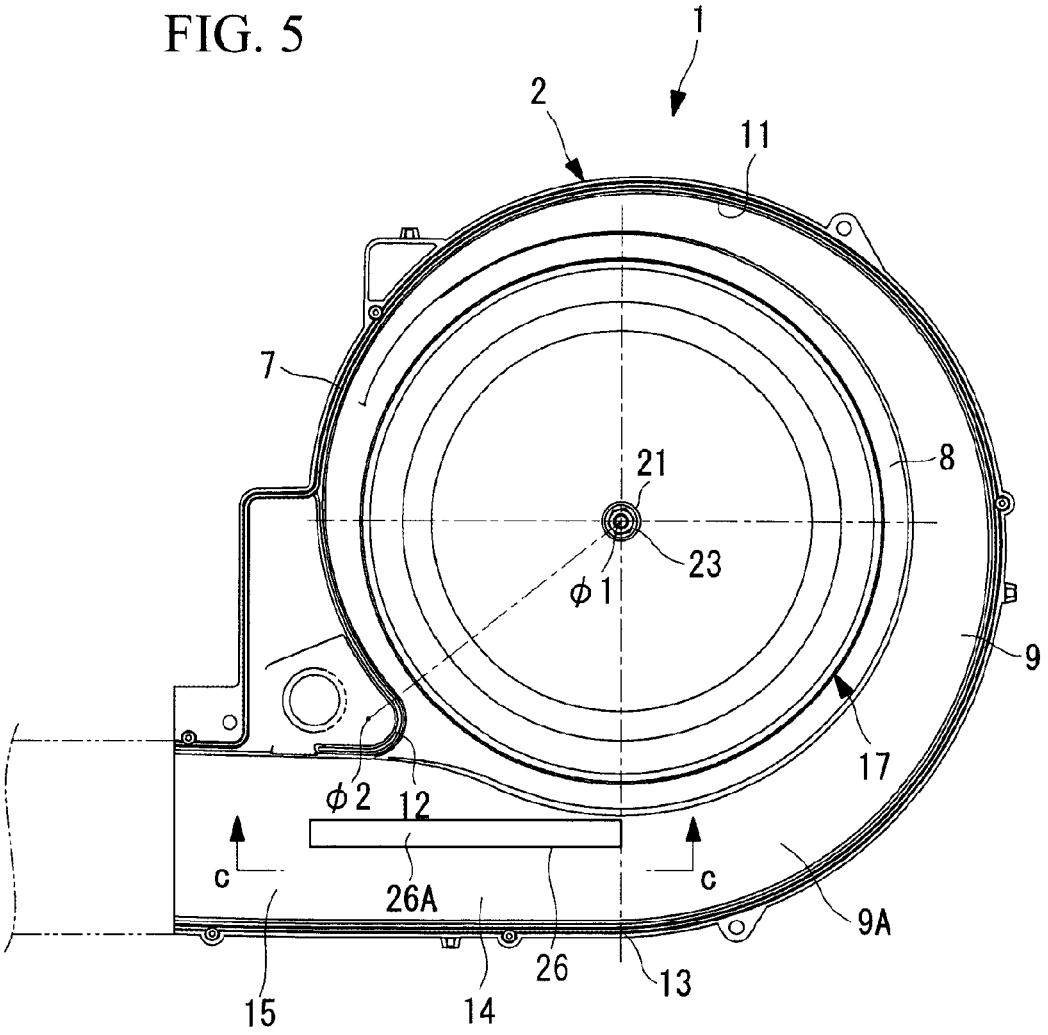
FIG. 5 is a lateral sectional view of a multi-blade centrifugal fan according to a second embodiment of the present invention, viewed from a lower casing side.
Figure 6:
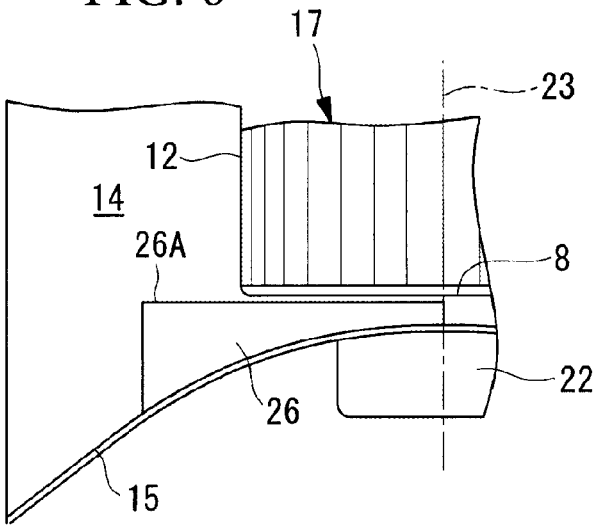
FIG. 6 is a sectional view of the multi-blade centrifugal fan shown in FIG. 5 taken along c-c.

As shown in FIGS. 5 and 6, with the configuration of this embodiment, the sub-blade 26 that simultaneously controls a secondary flow and the occurrence of turbulence in an airflow and vortices is provided along an airflow direction at a position closer to the inner circumference than the center portion on the wall surface of the diffuser portion 15 in the region of the outlet 14, which is downstream of the spiral-end portion 13 of the scroll casing 2 provided in the axially expanded portion 7A of the lower casing.

When a center portion of the channel width at the wall surface of the diffuser portion 15 in the region of the outlet 14 is defined as a 50% position, it is desirable that the sub-blade be provided within a range from 50 to 30%, which is closer to the inner circumference than the center portion. In addition, the sub-blade 26 is integrally molded with the lower casing 7 on the wall surface of the diffuser portion 15 in the region of the outlet 14 of the lower casing 7, and the thickness thereof is set to be from about several millimeters to about 10 mm. Furthermore, the height of a top end 26A of this sub-blade 26, that is, the height thereof in the rotation-axis direction, is set to be substantially the same height as the bottom surface 10 of the annular flange portion 8 of the scroll casing 2, and the area from an upstream end to a downstream end thereof is kept at substantially the same height.

As described above, the sub-blade 26 that simultaneously controls a secondary flow and the occurrence of turbulence in the airflow and vortices and is provided along an airflow direction at a position closer to the inner circumference than the center portion on the wall surface of the diffuser portion 15 in the region of the outlet 14, which is downstream of the spiral-end portion 13 of the axially expanded portion 7A that forms the air channel 9A expanded in the rotation-axis direction, and thereby, the airflow in the region of the outlet 14 downstream of the spiral-end portion 13 of the scroll casing 2 can be rectified by the sub-blade 26, the occurrence of flow reversal and turbulence in the main flow and vortices before and after the tongue portion can be suppressed, and the instability of the secondary flow in the direction perpendicular to the main flow can be suppressed.

Because of this, low-frequency noise (abnormal noise) having frequency components near 250 Hz and near 500 Hz, which are generated when the turbulence in the flow before and after the tongue portion 12 reaches the diffuser portion 15, can both be reduced. FIG. 11 is a drawing showing the noise reduction effect of providing the sub-blade 26; it was experimentally confirmed that, as compared with curve B for the case without the sub-blade 26, low-frequency noise having frequency components near 250 Hz and near 500 Hz were both reduced in curve A for the case with the sub-blade 26 and that an overall noise reduction of about 1.4 dBA was obtained.

In addition, because the top end 26A of the sub-blade 26 is set at substantially the same height as that of the bottom surface 10 of the annular flange portion 8 of the scroll casing 2, and the area thereof from the upstream end to the downstream end is kept at substantially the same height, the sub-blade 26 can rectify the main flow of the airflow that flows in the axially expanded portion 7A without interrupting the airflow that flows out from the impeller 17, and can suppress the occurrence of turbulence and vortices and instability of the secondary flow. Therefore, the airflow over the area from before and after the tongue portion 12 to the exit of the diffuser portion 15 in the region of the outlet 14 can be stabilized, and the occurrence of low-frequency noise near 250 Hz and near 500 Hz can both be reduced.

Furthermore, the sub-blade 26 is integrally molded with the wall surface of the diffuser portion 15 in the region of the outlet 14 downstream of the spiral-end portion 13 of the scroll casing 2. Accordingly, when providing the sub-blade 26 on the wall surface of the diffuser portion 15, it suffices to integrally mold it by making a portion of the wall surface protrude into the air channel 9A in the region of the outlet 14; therefore, it is possible to suppress an increase in the number of processing steps and an increase in cost caused by providing the sub-blade 26.

{Third Embodiment}

Next, a third embodiment of the present invention will be described by using FIGS. 7, 8, 12, and 13.

The configuration of this embodiment differs from the above-described first embodiment in that a vortex control plate 27 and a secondary-flow control plate 29 are provided instead of the protrusion 24 and the rib-like protrusions 25. Because other points are the same as those of the first embodiment, descriptions thereof will be omitted.

Figure 7:
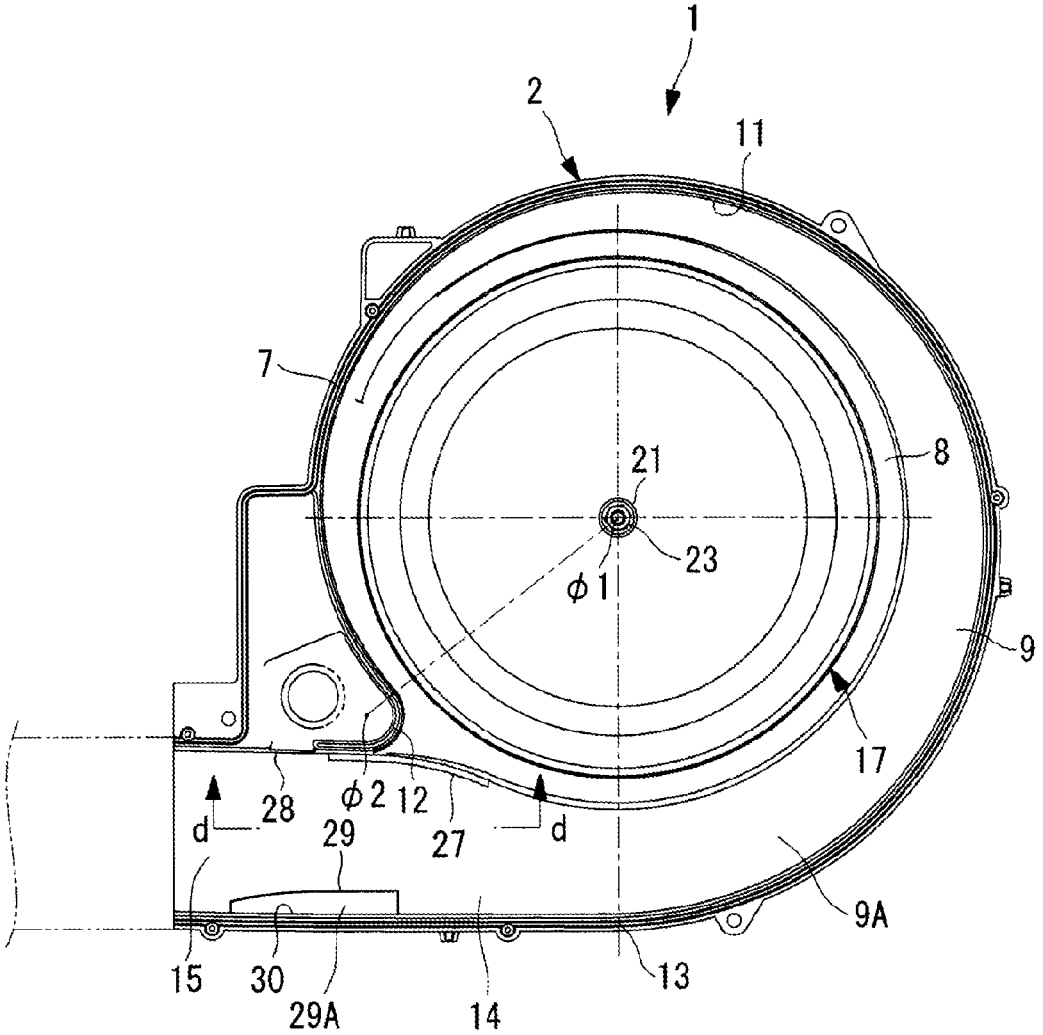
FIG. 7 is a lateral sectional view of a multi-blade centrifugal fan according to a third embodiment of the present invention, viewed from a lower casing side.
Figure 8:
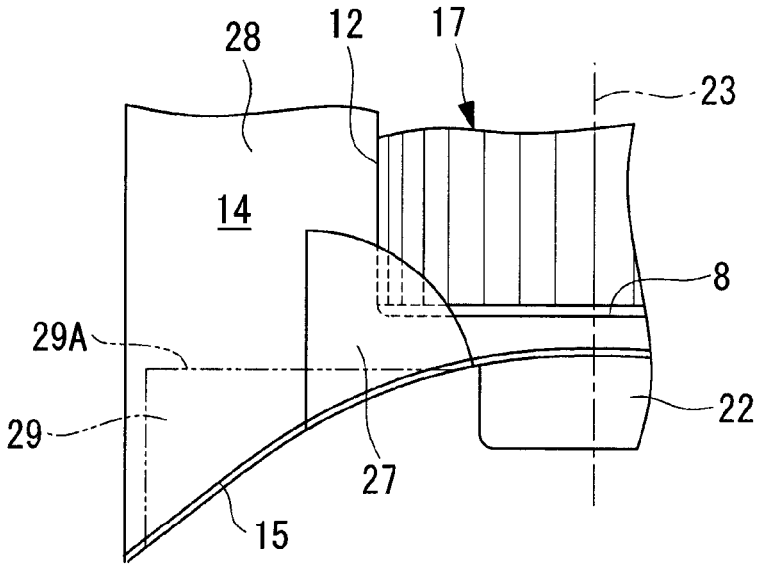
FIG. 8 is a sectional view of the multi-blade centrifugal fan shown in FIG. 7 taken along d-d.

As shown in FIGS. 7 and 8, in this embodiment, the vortex control plate 27, whose height in the rotation-axis direction is gradually increased over an area from upstream of the tongue portion 12 to an inner circumferential side surface in the region of the outlet 14, is provided near the tongue portion 12 in the region of the outlet 14, which is downstream of the spiral-end portion 13 of the scroll casing 2, in the axially expanded portion 7A provided in the lower casing 7. This vortex control plate 27 extends to a portion above the annular flange portion 8 at the bottom surface of the scroll casing 2.

In addition, the secondary-flow control plate 29, which controls a secondary flow at the diffuser portion 15, is provided over the area from the vicinity of the tongue portion 12 to the exit of the diffuser portion 15 on an outer circumferential surface 30 that faces the inner circumferential surface 28 in the region of the outlet 14 where the vortex control plate 27 is provided. In the secondary-flow control plate 29, the height thereof at a top end 29A in the rotation-axis direction is set to be substantially the same from the upstream side to the downstream side. Furthermore, the vortex control plate 27 and the secondary-flow control plate 29 described above are integrally molded, respectively, with the inner circumferential surface 28 and the outer circumferential surface 30 of the lower casing 7 which forms the scroll casing 2.

As described above, the vortex control plate 27, whose height in the rotation-axis direction is gradually increased over the area from upstream of the tongue portion 12 to the inner circumferential side surface 28 in the region of the outlet 14, is provided near the tongue portion 12 in the region of the outlet 14 downstream of the spiral-end portion 13 of the axially expanded portion 7A that forms the air channel 9A where the bottom surface 10 of the scroll casing 2 is expanded in the rotation-axis direction, and thereby, unstable fluctuations of vortices, in which the flow reversal of a flow and vortices due to flow separation simultaneously occur near the tongue portion 12 and the vortices swirl up from a lower portion the axially expanded portion 7A toward an upper portion thereof, can be suppressed with this vortex control plate 27. Accordingly, low-frequency noise (abnormal noise), having frequency components near 500 Hz generated when turbulence in the flow before and after the tongue portion 12 reaches the diffuser portion 15 can be reduced.

Figure 12:
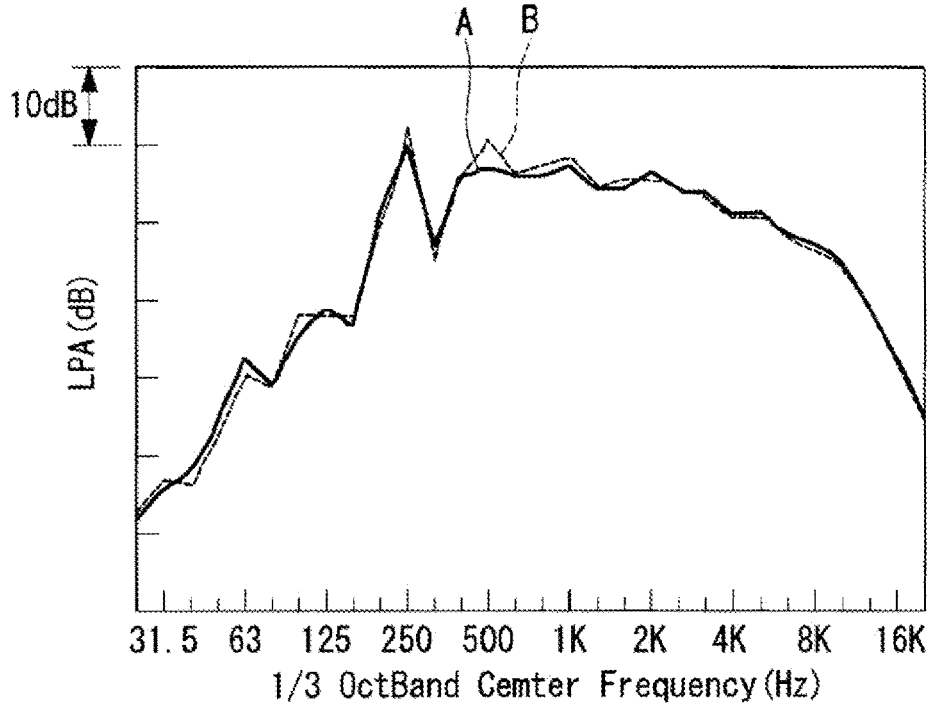
FIG. 12 is a diagram showing the noise reduction effect of the multi-blade centrifugal fan shown in FIG. 2 when only a vortex control plate is provided.

FIG. 12 is a diagram showing the noise reduction effect of providing the vortex control plate 27; it was experimentally confirmed that, as compared with curve B for the case without the vortex control plate 27, low-frequency noise having frequency components near 500 Hz was reduced in curve A for the case with the vortex control plate 27 and that an overall noise reduction of about 1.1 dBA was obtained.

In addition, the vortex control plate 27 extends to a portion above the annular flange portion 8 at the bottom surface 10 of the scroll portion 2. Accordingly, unstable fluctuations of vortices which swirl up from the lower portion of the axially expanded portion 7A toward the upper portion of the annular flange portion 8 near the tongue portion 12 can be suppressed with the vortex control plate 12 that extends to the portion above the annular flange portion 8. Therefore, low-frequency noise (abnormal noise) generated when turbulence in the flow before and after the tongue portion 12 reaches the diffuser portion 15 can be reduced.

Furthermore, in addition to the vortex control plate 27, the secondary-flow control plate 29 that controls the secondary flow at the diffuser portion 15 is provided in this embodiment over the area from the vicinity of the tongue portion 12 to the exit of the diffuser portion 15 on the outer circumferential side surface 30 side facing the inner circumferential side surface 28 in the region of the outlet 14. Accordingly, instability of the secondary flow that flows in the direction perpendicular to the circumferential-direction main flow that flows in the axially expanded portion 7A of the scroll casing 2 can be suppressed with the secondary-flow control plate 29 provided on the outer circumferential side surface 30 in the region of the outlet 14. Therefore, the secondary flow over the area from the vicinity of the tongue portion 12 in the region of the outlet 14 to the exit of the diffuser portion 15 can be stabilized, and the occurrence of low frequency noise (abnormal noise) near 250 Hz and near 500 Hz can both be reduced.

Figure 13:
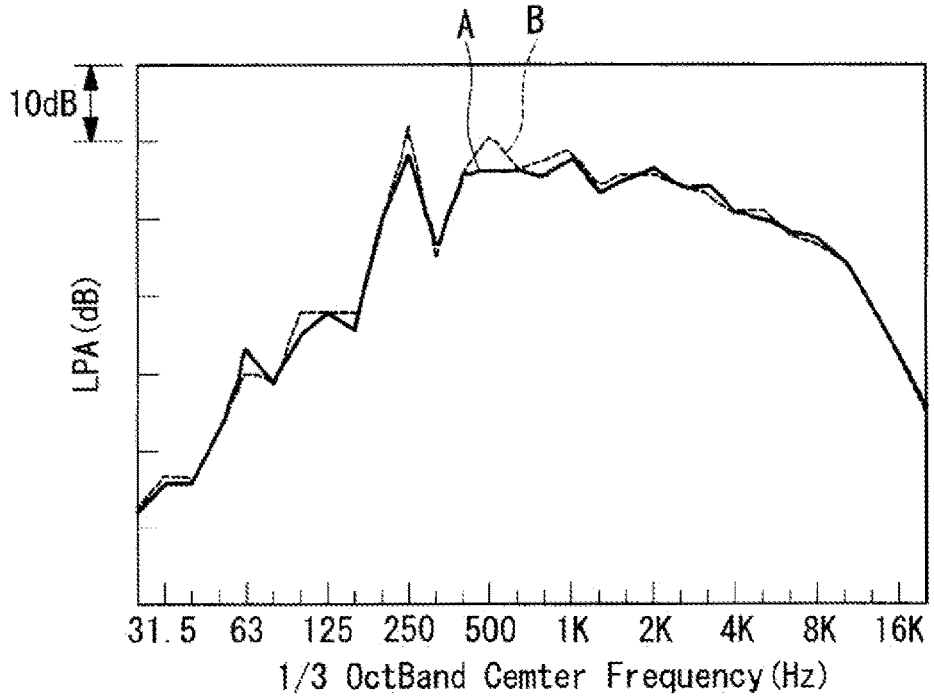
FIG. 13 is a diagram showing the noise reduction effect of the multi-blade centrifugal fan shown in FIG. 7 when a vortex control plate and a secondary-flow control plate are provided.

FIG. 13 is a diagram showing the noise reduction effect of providing the vortex control plate 27 and the secondary-flow control plate 29; it was experimentally confirmed that, as compared with curve B for the case without the vortex control plate 27 or the secondary-flow control plate 29, low-frequency noise having frequency components near 250 Hz and near 500 Hz were both reduced in curve A for the case with the vortex control plate 27 and the secondary-flow control plate 29 and that an overall noise reduction of about 1.4 dBA was obtained.

In addition, in the secondary-flow control plate 29, the height thereof at the top end 29A, that is, the height in the rotation-axis direction, is set to be substantially the same height from the upstream side to the downstream side; therefore, the instability of the secondary flow over the area from the vicinity of the tongue portion 12 to the exit of the diffuser portion 15 can be reliably suppressed and stabilized. As a result, the airflow over the area from the vicinity of the tongue portion 12 to the exit of the diffuser portion 15 can be stabilized, and the occurrence of low-frequency noise can be suppressed.

In addition, the vortex control plate 27 and the secondary-flow control plate 29 described above, respectively, are integrally molded on the inner circumferential surface 28 and the outer circumferential surface 30 of the lower casing 7 that forms the scroll casing 2. Accordingly, when providing the vortex control plate 27 and the secondary-flow control plate 29 on the inner circumferential side surface 28 near the tongue portion 12 and the outer circumferential side surface 30, respectively, over the area from the vicinity of the tongue portion 12 to the exit of the diffuser portion 15, it suffices to integrally mold them with the wall surfaces of the lower casing 7 so that portions thereof protrude inward into the air channel 9A; therefore, it is possible to suppress an increase in the number of processing steps and an increase in cost caused by providing the vortex control plate 27 and the secondary-flow control plate 29.

Note that the present invention is not limited to the inventions according to the above-described embodiments and can be appropriately modified within a range that does not depart from the gist thereof. For example, although examples of the multi-blade centrifugal fan 1 in which the rotation shaft 23 of the impeller 17 is vertically disposed are described in the above-described embodiments, as a matter of course, the rotation shaft 23 may be horizontally disposed. In addition, the multi-blade centrifugal fans 1 of the individual embodiments can widely be applied to blower fans in air conditioners for vehicle air conditioning devices, etc., and, because the occurrence of low-frequency noise can be reduced, it is possible to achieve further noise reduction and performance enhancement in air conditioners employing the multi-blade centrifugal fans 1.

REFERENCE SIGNS LIST

1 multi-blade centrifugal fan
2 scroll casing
7 lower casing
7A axially expanded portion
8 annular flange portion
9, 9A air channel
10 bottom surface
12 tongue portion
13 spiral-end portion
14 outlet
15 diffuser portion
17 impeller
20 blade
24 protrusion
25, 25A, 25B rib-like protrusion
26 sub-blade
26A top end of sub-blade
27 vortex control plate
28 inner circumferential surface of outlet region
29 secondary-flow control-plate
29A top end of secondary-flow control plate
30 outer circumferential surface of outlet region

The invention claimed is:

1. A multi-blade centrifugal fan comprising:

an impeller having numerous blades and provided in a freely rotatable manner in a scroll casing formed in a spiral shape with a tongue portion serving as its starting point, an axially expanded portion provided in the scroll casing that forms an air channel that is expanded in a rotation axis direction at a radially outer side of an annular flange portion that supports the impeller at the bottom surface of the scroll casing; and a vortex control plate provided near the tongue portion in a region of an outlet, the region of the outlet being provided on an air flow downstream side of a spiral-end portion of the the scroll casing and being provided in the axially expanded portion, and that is provided over an area from an air flow upstream side of the tongue portion in the region of the outlet to an inner circumferential side surface of the axially expanded portion in the region of the outlet, the height of the vortex control plate in a rotation-axis direction of the impeller gradually increased from an air flow upstream side to an air flow downstream side.

2. A multi-blade centrifugal fan according to claim 1, wherein the vortex control plate extends to above the annular flange portion at the bottom surface of the scroll casing.

3. A multi-blade centrifugal fan according to claim 1, wherein a secondary-flow control plate that controls a secondary-flow at the diffuser portion is provided at an outer circumferential side surface of the axially expanded portion, in the region of the outlet over an area from the vicinity of the tongue portion to the exit of the diffuser portion.

4. A multi-blade centrifugal fan according to claim 3, wherein an upper surface of the secondary-flow control plate is substantially in parallel with a plane orthogonal to the rotation-axis of the impeller.

5. A multi-blade centrifugal fan according to claim 3, wherein the vortex control plate and the secondary-flow control plate are integrally molded with bottom surface of the scroll casing.

6. An air conditioner in which a multi-blade centrifugal fan according to claim 1 is installed as a blower fan.

* * * * *